US007022051B2

(12) United States Patent
Ota

(10) Patent No.: US 7,022,051 B2
(45) Date of Patent: Apr. 4, 2006

(54) RUNNING MACHINE

(75) Inventor: Yoshitake Ota, Ichinoseki (JP)

(73) Assignee: Ohtake Root Kogyo Co., Ltd., Ichinoseki (JP)

( * ) Notice: Subject to any disclaimer, the term of this patent is extended or adjusted under 35 U.S.C. 154(b) by 0 days.

(21) Appl. No.: 10/872,904

(22) Filed: Jun. 21, 2004

(65) Prior Publication Data

US 2005/0202936 A1 Sep. 15, 2005

(30) Foreign Application Priority Data

Mar. 8, 2004 (JP) ..... P 2004-063465

(51) Int. Cl.
*A63B 22/02* (2006.01)

(52) U.S. Cl. ..... 482/54

(58) Field of Classification Search ..... 482/51, 482/54

See application file for complete search history.

(56) References Cited

U.S. PATENT DOCUMENTS 6,174,268 B1 * 1/2001 Novak ..... 482/54
6,334,839 B1 * 1/2002 Lim et al. ..... 482/54
6,607,469 B1 * 8/2003 Ota ..... 482/54

* cited by examiner

*Primary Examiner*—Stephen R. Crow
(74) *Attorney, Agent, or Firm*—Mitchell P. Brook, Esq.; Luce, Forward, Hamilton & Scripps LLP

(57) ABSTRACT

Even if the tension of the endless belt against the sliding contact member is reduced, the slip of the endless belt out of the rotary roller is prevented and the endless belt is smoothly moved. Also, since frictional resistance of the endless belt against the sliding contact member is reduced, durability of the endless belt can be substantially improved.

The present running machine comprises a rotary roller 23 for circulatingly move an endless belt 20 mounted to the bed-plate 10 and supported at a supporting plate 22 by a driving unit 26, a sliding contact member 25 for guiding the sliding-contact movement of the endless belt 20, a tension roller 30 for depressing the upper portion of the endless belt toward the lower portion, thereby making a distance of the upper portion and the lower portion smaller than the diameter of the rotary roller 23, and a tension/contact roller 40 depressing and contacting the endless belt 20 to the rotary roller 23. Further, the tension/contact roller 40 constitutes the tension roller 30, a tension/contact force-regulating unit 43 is provided to regulate the tension/contact force of tension/contact roller 40, and a position-adjusting unit 50 for adjusting the fore and rear positions of the sliding contact member 25 is provided.

10 Claims, 8 Drawing Sheets

RUNNING MACHINE

BACKGROUND OF THE INVENTION

1. Field of the Invention

The present invention relates to a running machine which is usually used indoors for exercise or medical treatment.

2. Description of the Related Art

This type of running machine is, for example, described in a patent document 1 (Japanese Unexamined Laid-open Patent Publication No. 2002-85586) which the applicant previously filed, as shown in FIG. 9. This running machine is a slim type for easy getting on it, and thus the elderly people or the disabled can easily use it. Further, the machine is constructed to give a shock to a user as little as possible even if he or she falls down to a ground surface during running/walking.

As shown in FIG. 9, the running machine comprises, a bedplate 1 having side frames (not shown) separated from each other and being contacted to a ground surface; an endless belt 2 mounted between the side frames of the bedplate 1 and bent down at its ends; a supporting plate 3 bridged between the side frames of the bedplate 1, inserted between an upper portion and a lower portion of the endless belt 2 and coming into a sliding-contact with the upper portion of the endless belt 2 for supporting the same; a rotary roller 4 provided in an inner portion of one bent part of the endless belt 2 for circulatingly moving the endless belt 2; a sliding contact member 5 mounted at one end of the supporting plate 3 in an inner portion of the other bent part of the endless belt 2 and guiding the sliding-contact movement of the endless belt 2; a driving unit 6 consisting of an electric motor 6*a* and a belt transmission 6*b* for rotating and driving the rotary roller 4; and a tension roller 7 for depressing the upper portion of the endless belt 2 toward the lower portion, thereby making a distance L between the upper portion and the lower portion smaller than a diameter D of the rotary roller 4.

With such a constitution, since the upper portion of the endless belt 2 is depressed toward the lower portion by the tension roller 7 and thus the distance L between the upper portion and the lower portion becomes smaller than the diameter D of the rotary roller 4, it is possible to make a height H from a ground surface G to a running/walking surface of the endless belt 2 as small as possible without reducing an outer diameter of the rotary roller 4.

The reason why the sliding contact member 5 sliding-contact with the endless belt 2, rather than the rotary roller, is mounted at the end of the supporting plate 3 is as follows. Since the height H from the ground surface G to the running/walking surface of the endless belt 2 is small, if the rotary roller is used instead of the sliding contact member 5, a shaft or a bearing for the roller is required. Thus, it becomes structurally difficult to mount a roller having a corresponding roller diameter. Further, even if the roller having a corresponding diameter can be mounted, its strength is weak because the diameter of the roller is small. In addition, because a substantial tensile force is applied to the endless belt 2, a shake or torsion occurs in the roller and the endless belt 2 cannot smoothly slide and thus immediately stops, or the endless belt 2 rolls from side to side and thus contacts the bedplate resulting in damage and mechanical troubles.

In using the above running machine, a runner/walker gets on the endless belt 2 from the other bent part of the endless belt 2. At this time, since the height H from the ground surface G to the running/walking surface of the endless belt 2 is very small, it is easy to get on the endless belt 2. In this condition, the endless belt 2 is circulatingly moved, and the runner/walker walks or runs on the running/walking surface of the upper portion according to the moving speed of the endless belt 2. During this walking/running, even if the runner/walker unwantedly falls down from the other bent part of the endless belt 2, the shock can be reduced since the height from the ground surface G to the running/walking surface of the endless belt 2 is very small. When the runner/walker wants to stop running/walking, he or she gets down from the other bent part of the endless belt 2. Likewise, since the height H from the ground surface G to the running/walking surface of the endless belt 2 is very small, it is easy to get down from the endless belt.

In the conventional running machines, it is a slim type and thus sliding contact member 5 for guiding the endless belt 2 so as to slidingly move in contact with it is mounted at the end of the supporting plate 3. However, since a substantial tensile force is applied to the endless belt 2, frictional resistance increases and thus durability of the endless belt 2 is heavily affected. Meanwhile, if frictional force is reduced by decreasing the tension of the endless belt 2 against the sliding contact member 5 to solve such problems, a slip out of the rotary roller 4 occurs and thus the endless belt 2 is not moved smoothly.

SUMMARY OF THE INVENTION

Accordingly, the present invention has been made to solve the above-mentioned problems occurring in the prior art. The object of the present invention is to provide a running machine enabling the endless belt 2 to smoothly move by preventing a slip out of the rotary roller from occurring even if the tension of the endless belt against the sliding contact member is reduced, and having improved durability by reducing frictional resistance of the endless belt against the sliding contact member.

In order to accomplish this object, there is provided a running machine comprising, a bedplate having side frames mounted at an interval and being contacted to a ground surface; an endless belt mounted between the side frames of the bedplate, bent down at its ends and provided with an upper portion externally positioned and having an outer surface as a running/walking surface on which a runner/walker runs or walks and a lower portion internally positioned; a supporting plate bridged between the side frames of the bedplate, inserted between the upper portion and the lower portion of the endless belt and coming into a sliding-contact with the upper portion of the endless belt for supporting the same; a rotary roller provided in an inner portion of one bent part of the endless belt for circulatingly moving the endless belt; a sliding contact member mounted in an inner portion of the other bent part of the endless belt and guiding the sliding-contact movement of the endless belt; a driving unit for rotating and driving the rotary roller; a tension roller for depressing the upper portion of the endless belt toward the lower portion, thereby making the distance between the upper portion and the lower portion smaller than the diameter of the rotary roller; and a tension/contact roller for depressing and contacting the endless belt to the rotary roller.

With such constitution, even if the tension of the endless belt against the sliding contact member is reduced, since the endless belt is depressed and contacted to the rotary roller by the tension/contact roller, the endless belt is inserted and supported between the rotary roller and the tension/contact roller, so that an endless belt slip out of the rotary roller is prevented and the endless belt is smoothly moved. Also, since frictional resistance of the endless belt against the sliding contact member can be reduced, durability of the endless belt can be substantially improved.

Also, since the present running machine is equipped with the tension roller, which depresses the upper portion of the endless belt toward the lower portion, thereby making the distance between the upper portion and the lower portion of the endless belt smaller than the diameter of the rotary roller, the height from the ground surface to the running/walking surface of the endless belt can be reduced as much as possible without reducing the outer diameter of the rotary roller Further, the tension/contact roller constitutes with the tension roller as required. Since it is possible to make the tension roller and the tension/contact roller compatible, the number of components can be correspondingly reduced resulting in cost saving.

Also, a tension/contact force-regulating unit is optionally provided to regulate tension/contact force of the tension/contact roller. By this constitution, the endless belt-maintaining force provided by the rotary roller and the tension/contact roller can be properly regulated, so that smooth circulating movement of the endless belt is achieved.

Further, the present running machine is optionally equipped with a position-adjusting unit, which can adjust front and rear positions of the sliding contact member. This unit regulates the tension of the endless belt against the sliding contact member, so that frictional resistance can be properly adjusted and the endless belt can smoothly moved, thereby substantially improving durability of the endless belt.

In this case, as required, the sliding contact member may constitute an end of the supporting plate, and the position-adjusting unit is so structured that it can change a mounting position of the supporting plate relative to the bedplate, thereby adjusting front and rear positions of the sliding contact member. Only by adjusting the mounting position of the supporting plate, the tension of the endless belt against the sliding contact member can be regulated, thereby frictional resistance being properly adjusted. Further, the adjusting operation can be easily done.

Also, in this case, as required, the sliding contact member may be mounted to an end of the supporting plate and made of a member different from the supporting plate, and the position-adjusting unit is such structured that it can change a mounting position of the sliding contact member relative to the supporting plate, thereby adjusting front and rear positions of the sliding contact member. Only by adjusting the mounting position of the sliding contact member, the tension of the endless belt against the sliding contact member can be regulated, thereby frictional resistance being properly adjusted. Accordingly, the adjusting operation can be easily done.

Also, the sliding contact member is optionally formed to protrude from a general plane of the supporting plate. Since the end of the endless belt is lifted relatively to the sliding contact member, frictional resistance of the endless belt against the general plane of the supporting plate is reduced and thus durability of the endless belt is improved.

Optionally, the height from the ground surface to the running/walking surface of the endless belt is 40 mm or less. When a runner/walker gets on or off from the other bent part of the endless belt, it is easy to get on or off. Further, even if the runner/walker falls down from the other bent part of the endless belt during running/walking, the shock can be surely relieved and safety can be improved.

DETAILED DESCRIPTION OF THE PREFERRED EMBODIMENTS

Figure 1:
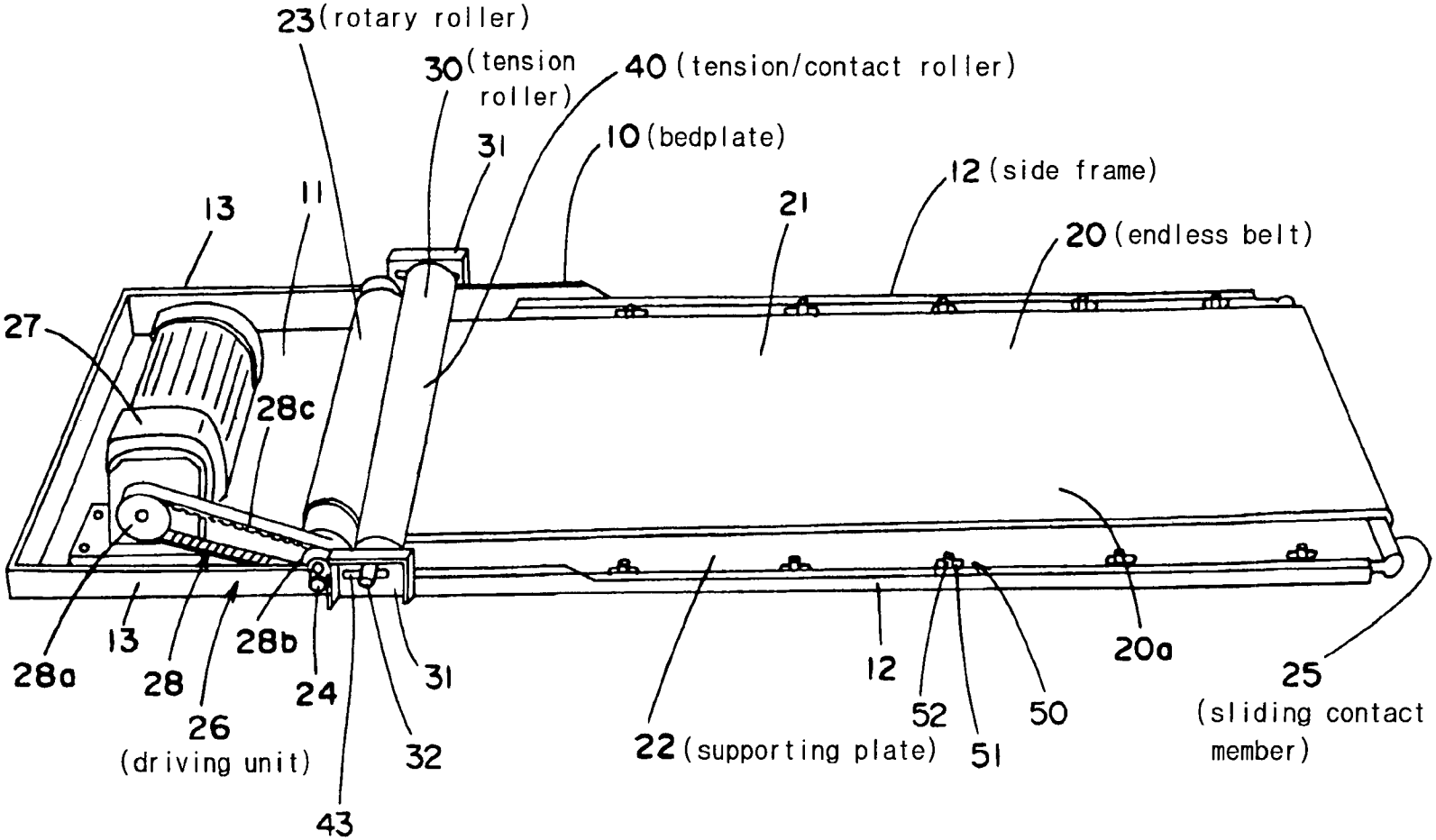
FIG. 1 is a perspective view showing a running machine according to an embodiment of the present invention.

Hereinafter, preferred embodiments of the present invention will be described with reference to the accompanying drawings. In the following description of the present invention, a detailed description of known functions and configurations incorporated herein will be omitted when it may make the subject matter of the present invention rather unclear.

As shown in FIG. 1 to FIG. 6, a running machine according to the present invention is provided with a bedplate 10 being contacted to a ground surface comprising a base plate 11 of a rectangular shape made of a metal and mounted in a frontal portion and side frames 12 consisting of a pair of metallic rod members which are provided at an interval and rearward extending at both sides of the base plate 11. The base plate 11 is provided with lateral plates 13 mounted to both sides thereof. Further, anti-sliding plates 14 made of rubber and being contacted to the ground surface (FIG. 6) are attached on bottom surfaces of the side frames 12 and the base plate 11.

Reference numeral 20 designates a flexible endless belt made of resin. The endless belt 20 is mounted between the side frames 12 of the bedplate 10 and extended into the base plate 11. The belt is bent down at its ends to form an upper portion 20*a* externally positioned and defining an outer surface thereof as a running/walking surface 21 and a lower portion 20*b* internally positioned.

Reference numeral 22 designates a supporting plate made of hard resin, bridged between the side frames 12 of the bedplate 10, inserted between the upper portion 20*a* and the lower portion 20*b* of the endless belt 20 and coming into a sliding-contact with the upper portion 20*a* of the endless belt 20 for supporting the same.

Figure 2:
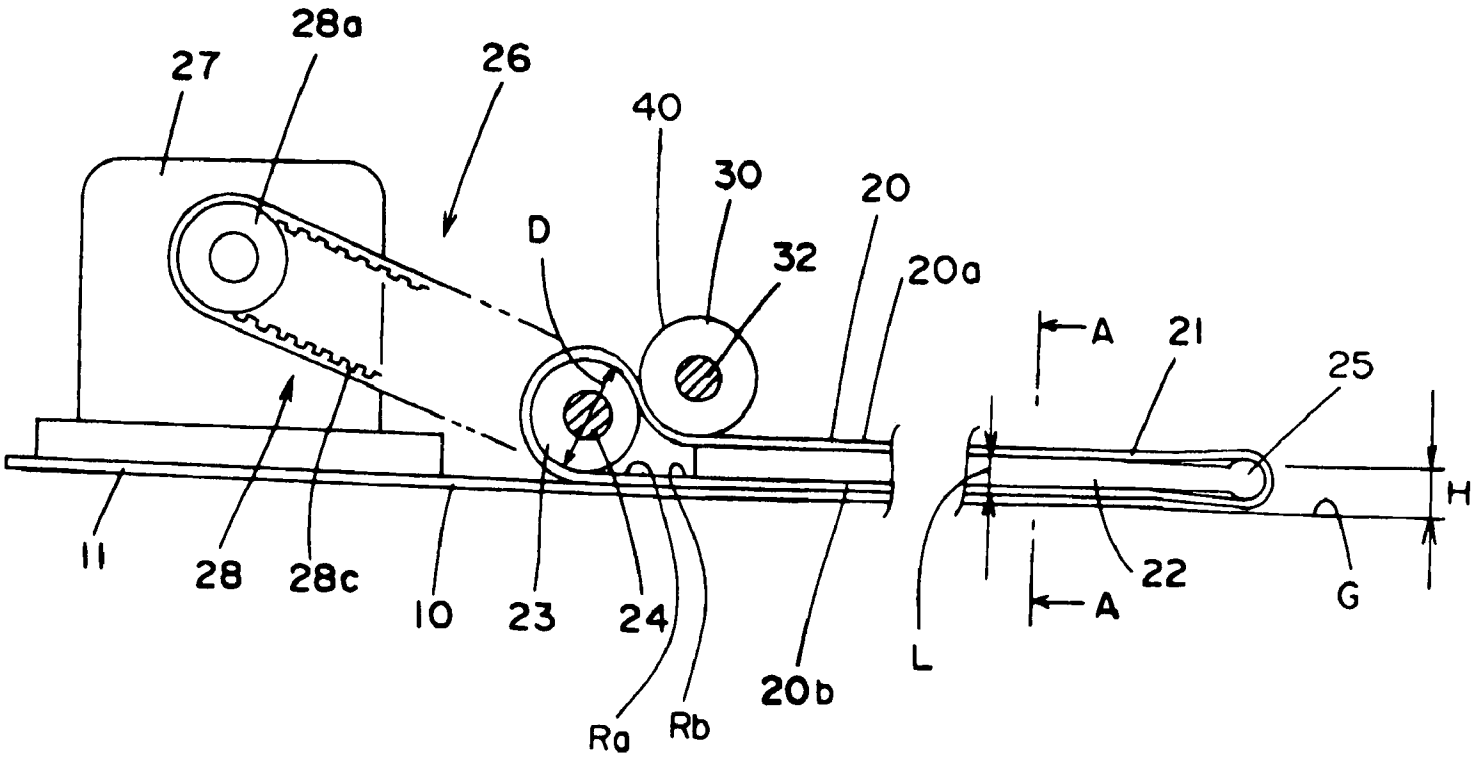
FIG. 2 shows a side sectional view of main parts of a running machine according to an embodiment of the present invention.

Reference numeral 23 designates a rotary roller mounted in an inner portion of one bent part of the endless belt 20 for circulatingly moving the endless belt 20. The rotary roller 23 is coupled to a shaft 24 bridged between the lateral plates 13 of the base plate 11 for a rotational movement. Also, as shown in FIG. 2, the rotary roller 23 is so arranged and positioned such that a lower tangent line Ra of the rotary roller 23 can be in accordance with a surface Rb of the lower portion 20*b* of the endless belt 20 along the supporting plate 22. With this constitution, the lower portion 20*b* of the endless belt 20 can be wound around the rotary roller 23 without being bended. Therefore, the endless belt 20 has a simplified structure and a reduced resistance and can be smoothly circulatingly moved.

For the rotary roller 23, it is preferable to line a metallic or resinous main body with rubber (not shown) having high frictional resistance, or to form a knurling on the metallic or resinous main body. By this means, frictional resistance against the endless belt 20 increases and the slip is prevented.

Figure 5:
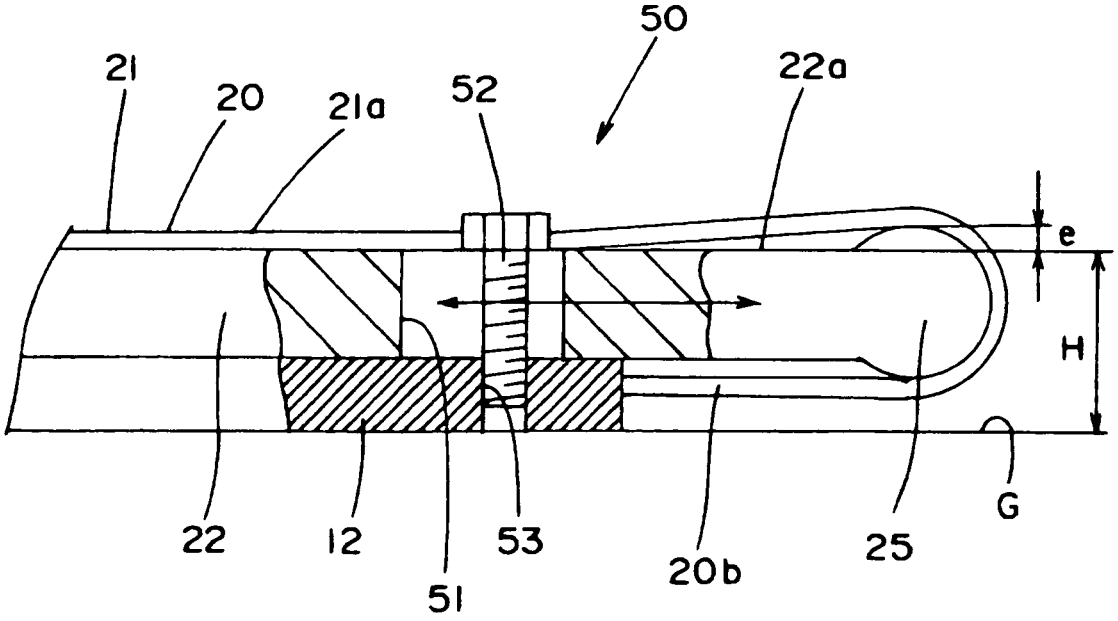
FIG. 5 is an enlarged partially taken side view showing constitution of back end of the running machine according to the embodiment of the present invention.

Reference numeral 25 designates a sliding contact member mounted in an inner portion of the other bent part of the endless belt 20 for guiding the endless belt so as to circulatingly move, and being capable of coming into a sliding-contact with the endless belt 20. As shown in FIG. 2 and FIG. 5, the sliding contact member 25 constitutes an end of the supporting plate 22 and has a semi-circular cross section. Further, the sliding contact member 25 is formed to protrude from a general plane 22*a* of the supporting plate 22 by length e.

Figure 3:
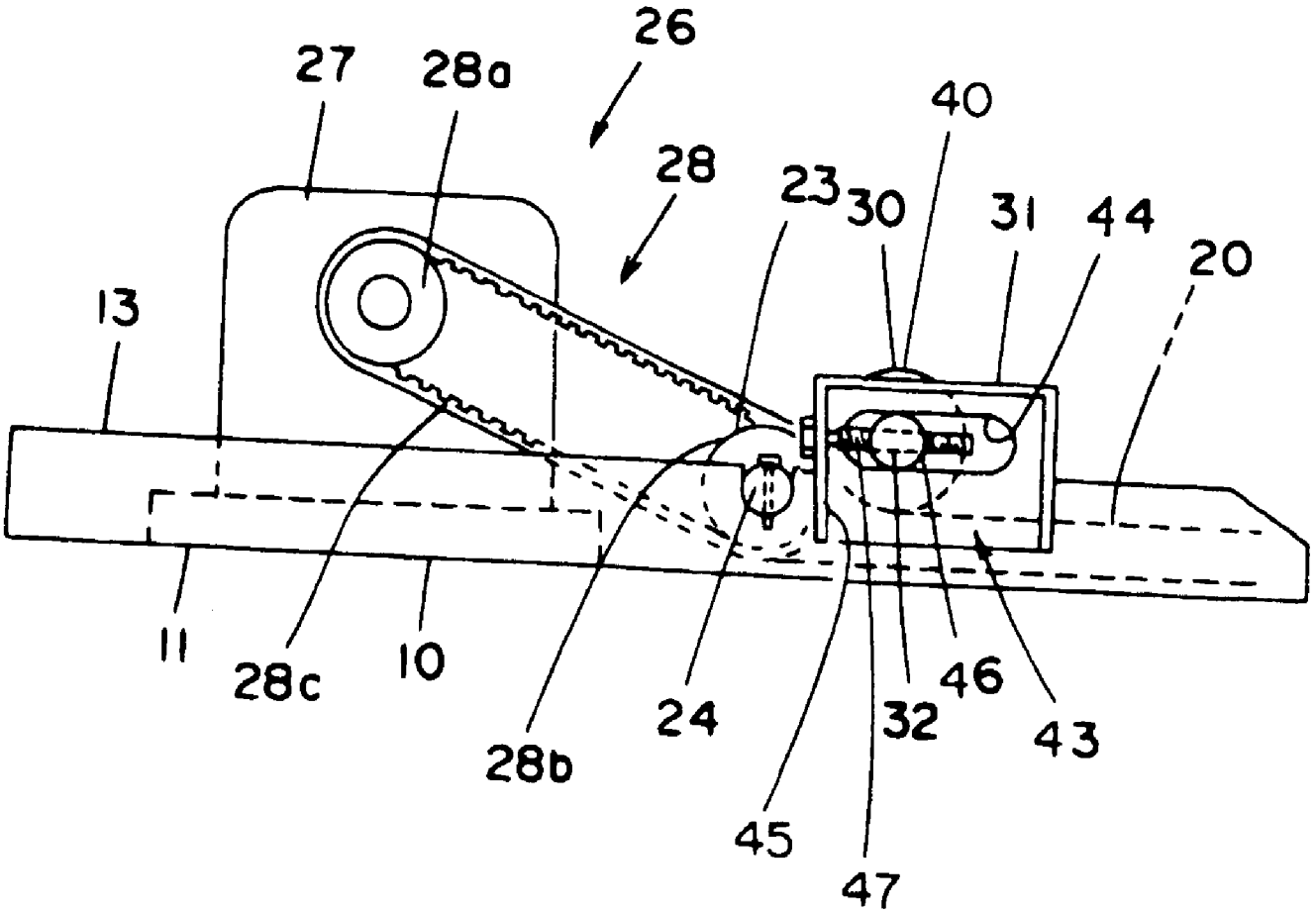
FIG. 3 is a side view showing main parts of a running machine according to an embodiment of the present invention.

Reference numeral 26 designates a driving unit for rotatingly driving the rotary roller 23. As shown in FIG. 1 to FIG. 3, the driving unit 26 is provided with an electric motor 27 mounted on the base plate 11 and a power transmission 28 for transmitting the rotation of the electric motor 27 to the rotary roller 23. The power transmission 28 comprises a driving sprocket 28*a* mounted to a rotating shaft of the electric motor 27, a driven sprocket 28*b* which is coaxially mounted to an end of the rotary roller 23 and coupled to the shaft 24 for a rotational movement, and a timing belt 28*c* wound on the driving sprocket 28*a* and the driven sprocket 28*b*.

As shown in FIG. 2, reference numeral 30 designates a tension roller 30 for depressing the upper portion 20*a* of the endless belt 20 toward the lower portion 20*b*, thereby making an distance L between the upper portion 20*a* and the lower portion 20*b* smaller than a diameter D of the rotary roller 23. The tension roller 30 is rotatably supported to the shaft 32 bridged between mounting members 31 mounted to the lateral plates 13 of the base plate 11. Thus, since the upper portion 20*a* of the endless belt 20 is depressed toward the lower portion 20*b* by the tension roller 30, the distance L between the upper portion 20*a* and the lower portion 20*b* can be smaller than the diameter D of the rotary roller 23, making the assembly of the endless belt 20 of such a slim type. In the embodiment, the height H from the ground surface G to the running/walking surface 21 of the endless belt 20 is 40 mm or less. For example, the height H is 30 mm.

Reference numeral 40 designates a tension/contact roller for depressing and contacting the endless belt 20 to the rotary roller 23. The tension/contact roller 40 consists of the tension roller 30. Since it is possible to make the tension roller and the tension/contact roller compatible, the number of components can be reduced resulting in cost saving.

Reference numeral 43 designates a tension/contact force-regulating unit for regulating tension/contact force of the tension/contact roller 40 against the rotary roller 23. As shown in FIG. 3, the tension/contact force-regulating unit 43 comprises an elongate hole 44 and a bolt 47. The elongate hole 44 is formed in the mounting member 31 and the shaft 32 is movably inserted through the slot hole. The bolt 47 is rotatably mounted in an outward member 45 outwardly mounted at an end of the mounting member 31 facing the electric motor 27 and engaged with a female thread 46 formed through the shaft 32 along the line perpendicular to an axis of the shaft 32. The rotation of the bolt 47 changes the engagement position of the female thread 46 of the shaft 32 relative to the bolt 47 and thus can regulate the tension/contact force of the tension/contact roller 40 (tension roller 30) against the endless belt 20 without adjusting the position of the tension/contact roller 40 (tension roller 30).

Figure 4:
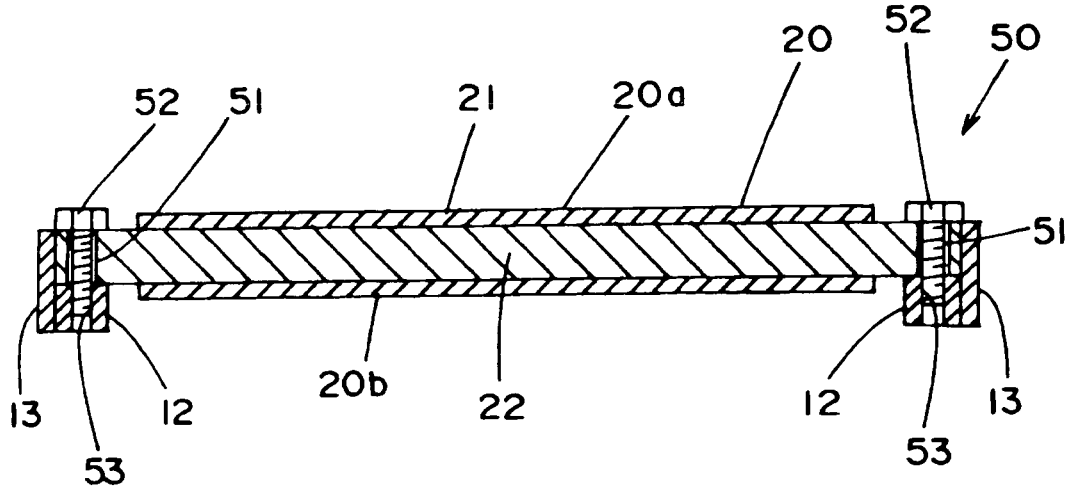
FIG. 4 depicts a sectional view of the running machine according to the embodiment of the present invention, taken along the line A—A in FIG. 2.

Reference numeral 50 designates a position-adjusting unit capable of adjusting front and rear positions of the sliding contact member 25. As shown in FIG. 1, FIG. 4 and FIG. 5, the position-adjusting unit 50 changes the mounting position of the supporting plate 22 relative to the bedplate 10 and thus adjusts the front and rear positions of the sliding contact member 25. Specifically, a plurality of elongate holes 51 are formed back and forth in right and left sides of the supporting plate 22 at predetermined intervals, and female threads 53 with which mounting bolts 52 inserted into the holes 41 are respectively engaged are formed in the side frames 12. With such a constitution, the movement of the supporting plate 22 relative to the side frames 12 within the range of the slot hole 51 adjusts the front and rear positions of sliding contact member 25, and the engagement of the mounting bolt 52 with the female thread 53 causing the supporting plate 22 to be fixed can set the front and rear positions of the sliding contact member 25.

Figure 6:
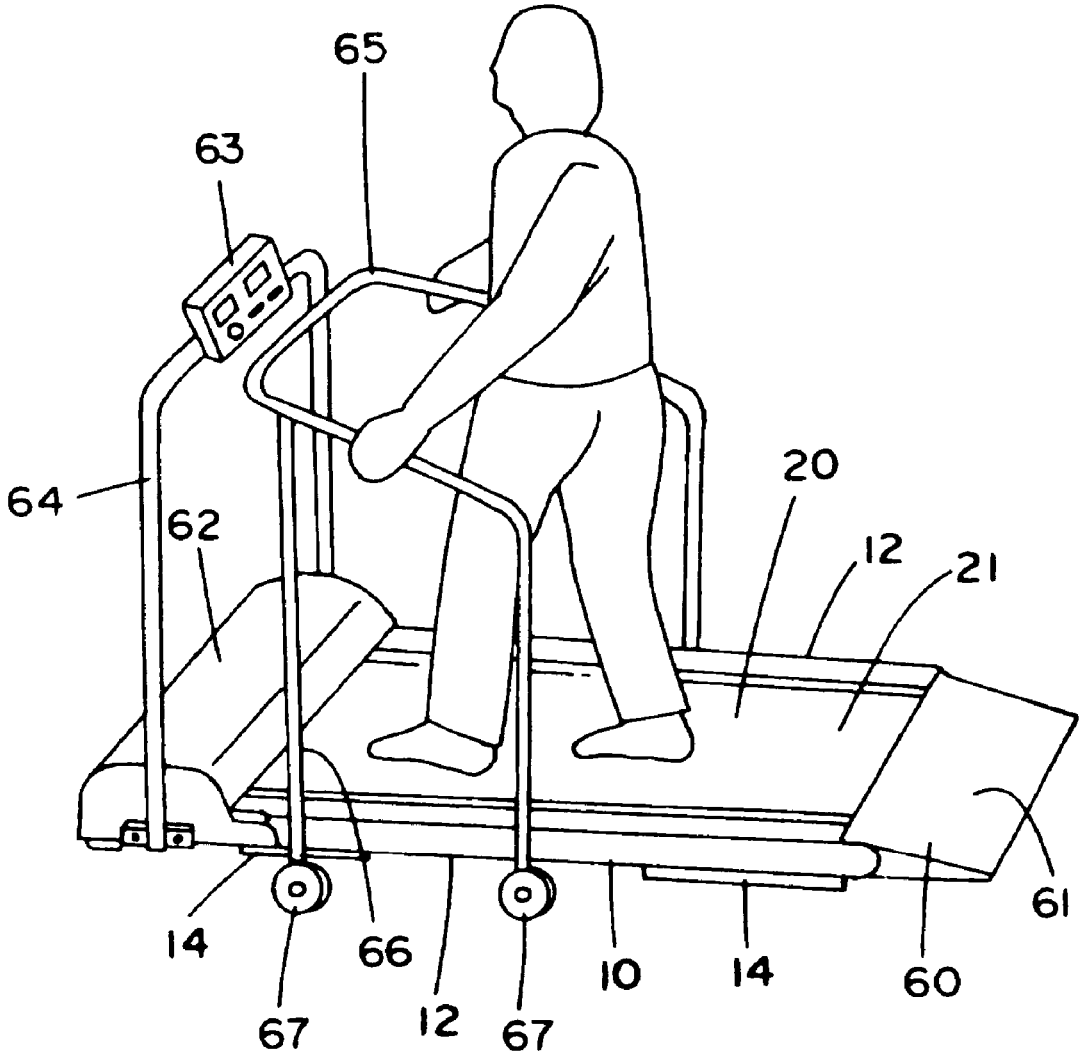
FIG. 6 is a perspective view showing the running machine according to the embodiment of the present invention during use.

As shown in FIG. 6, reference numeral 60 designates an inclined plate having an inclined surface 61 extending from the ground surface to the other bent part of the endless belt 20 and being fixed at the bedplate 10. In FIG. 6, reference numeral 62 designates a motor cover for covering the electric motor 27 mounted on the base plate 11 of the bedplate 10, and reference numeral 63 designates a controller controlling the number of rotations of the electric motor 27 and mounted to an arch-shaped member 64 uprightly mounted to the base plate 11. Reference numeral 65 designates an auxiliary member supporting a runner/walker so as to facilitate his or her exercise, i.e., running or walking and equipped with a frame member 66 across the side frames 12 of the bedplate 10 for the runner/walker's grasping and conveying wheels 67 at lower side thereof The operation of the running machine according to this embodiment is described below. Previously, the tension of the tension/contact roller 40 (tension roller 30) applied to the endless belt 20 is regulated by the tension/contact force-regulating unit 43. Thus, the endless belt 20 is inserted and supported between the rotary roller 23 and the tension/contact roller 40 and the tension/contact force is properly regulated at the same time. Therefore, the slip of the endless belt 20 out of the rotary roller 23 is inhibited, and the endless belt 20 is smoothly moved.

Further, the mounting position of the supporting plate 22 relative to the bedplate 10 and the fore and rear positions of the sliding contact member 25 are adjusted with the position-adjusting unit 50. In this case, the tension of the endless belt 20 against the sliding contact member 25 and thus frictional resistance are regulated simply by unfastening the mounting bolt 52 so as to adjust the mounting position of the supporting plate 22 and fastening the mounting bolt 52 again. Thus, the regulation operation can be easily done. With such constitutions, it is possible to reduce frictional resistance of the endless belt 20 against the sliding contact member 25. As a result, the circulating movement of the endless belt 20 becomes smooth.

In using the running machine, as shown in FIG. 6, a runner/walker gets on the endless belt 20 from the other bent part of the endless belt 20. At this time, since there is the inclined plate 60, the runner/walker can easily approach the endless belt 20 through stepping on the inclined plate 60. Also, since the distance L between the upper portion 20*a* and the lower portion 20*b* of the endless belt 20 is small, the height H from the ground surface G to the running/walking surface 21 of the endless belt 20 is very small, e.g., 40 mm or less, making it easier for the runner/walker to get on the endless belt compared to the prior art.

In using the running machine, the runner/walker may properly set the rpm of the electric motor 27 of the driving unit 26 using the controller 63 so as to circulatingly move the endless belt 20 while grasping the auxiliary member 65 as required, and then runs or walks on the running/walking surface 21 of the upper portion 20*a* according to the moving speed of the endless belt 20.

In this case, in the circulating movement of the endless belt 20, even if the tension of the endless belt 20 against the sliding contact member 25 is somewhat reduced by the position-adjusting unit 50, since the endless belt 20 is depressed and contacted to the rotary roller 23 by the tension/contact roller 40, the endless belt 20 is inserted and supported between the rotary roller 23 and the tension/contact roller 40, and thus the slip of the endless belt 20 out of the rotary roller 23 is prevented and the endless belt 20 is moved smoothly. Also, since it is possible to set frictional resistance of the endless belt 20 against the sliding contact member 25 small by the position-adjusting unit 50, abrasion is reduced and durability of the endless belt 20 is correspondingly improved.

Furthermore, as shown in FIG. 5, since the sliding contact member 25 is formed to protrude from the general plane 22*a* of the supporting plate 22, the end of the endless belt 20 is lifted relatively to the sliding contact member 25. Accordingly, frictional resistance of the endless belt 20 against the general plane 22*a* of the supporting plate 22 becomes small and thus durability of the endless belt 20 is further improved.

Also, during the exercise, even if the runner/walker missteps to be in a situation where he or she cannot follow the speed of the endless belt, so that he or she falls down from the other bent part of the endless belt 20, the runner/walker can get on the inclined plate 60, and thus shock is correspondingly reduced. Also, when the runner/walker falls down from the endless belt 20, since the distance L between the upper portion 20*a* and the lower portion 20*b* of the endless belt 20 is small, the height H from the ground surface G to the running/walking surface 21 of the endless belt 20 is small, e.g., 40 mm or less, thereby making it possible to reduce the shock.

When the runner/walker wants to stop running or walking, he or she manipulates the controller 63 which in turn stops the electric motor 27 of the driving unit 26 and then gets off the running machine while stepping on the inclined plate 60. At this time, the runner/walker may slowly and easily step on the inclined plate 60 to get down from the endless belt 20. Also, since the distance L between the upper portion 20*a* and the lower portion 20*b* of the endless belt 20 is small, the height H from the ground surface G to the running/walking surface 21 of the endless belt 20 is very small, e.g., 40 mm or less, thereby making it easy for the runner/walker to get off the endless belt compared to the prior art.

Figure 7:
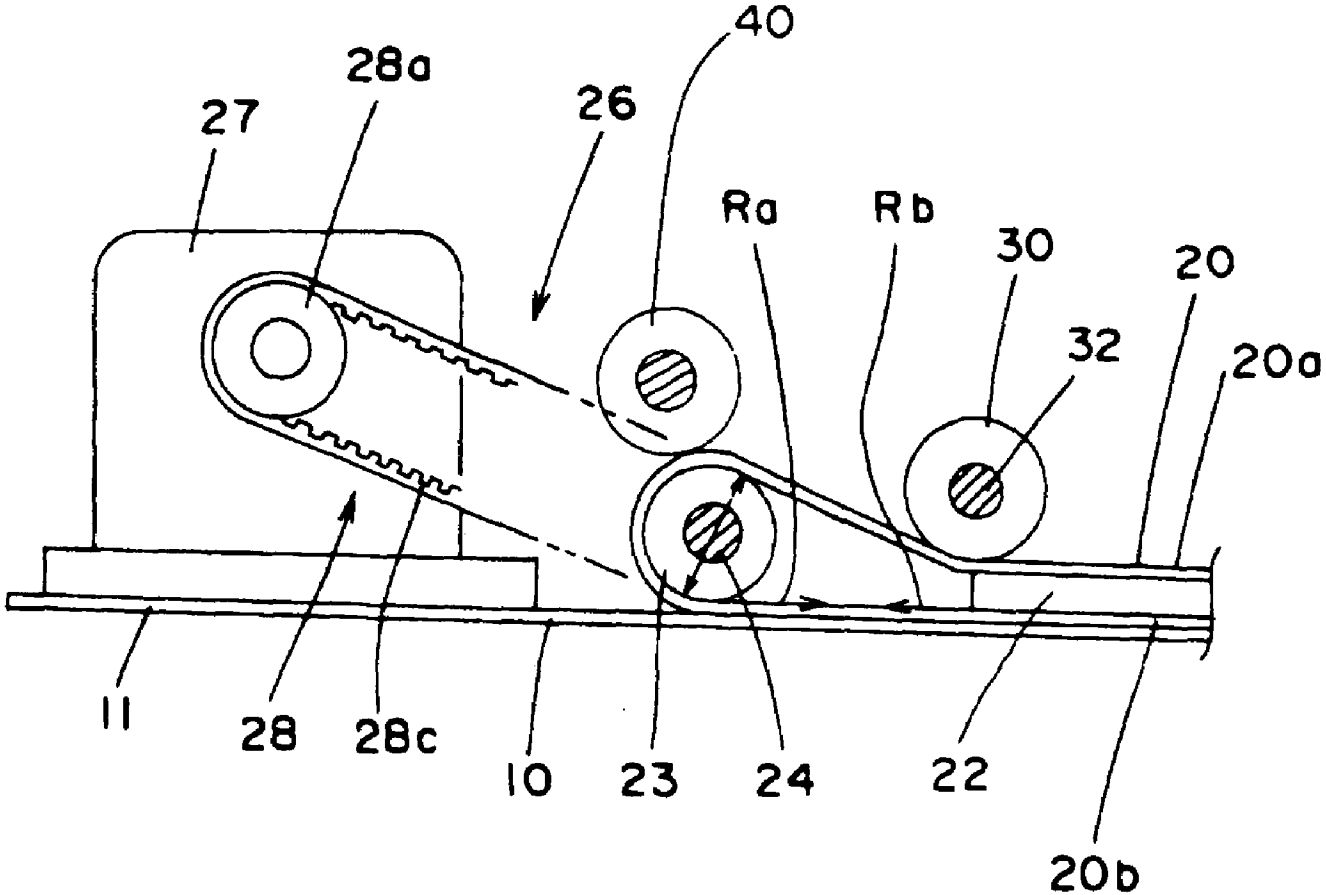
FIG. 7 illustrates a side sectional view of main parts of a running machine according to another embodiment of the present invention, corresponding to FIG. 2.

FIG. 7 shows another embodiment of the present invention. In this embodiment, the tension roller 30 is separated from the rotary roller 23, and the tension/contact roller 40 is separately provided from the tension roller 30 at the side facing the electric motor 27. Such a combination of the tension roller 30 and the tension/contact roller 40 also provides the same operation and effect as above.

Figure 8:
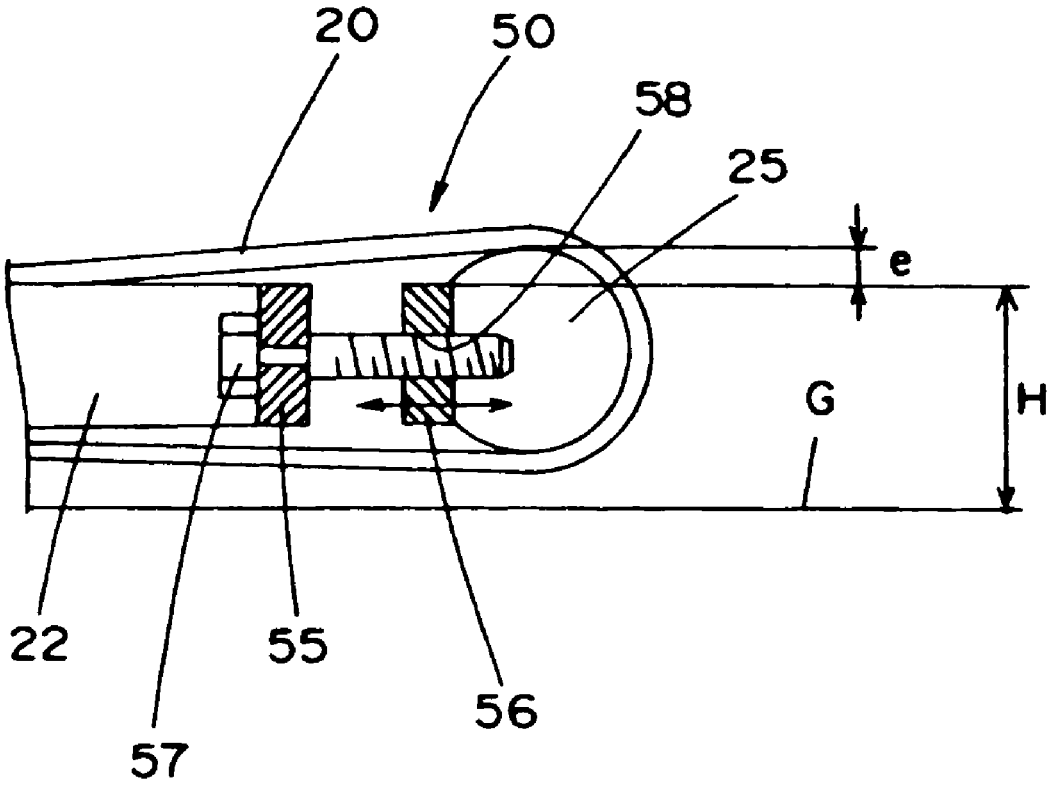
FIG. 8 is an enlarged view showing main parts of a modified embodiment of a sliding contact member and a position-adjusting unit of the running machine according to the embodiment of the present invention.
Figure 9:
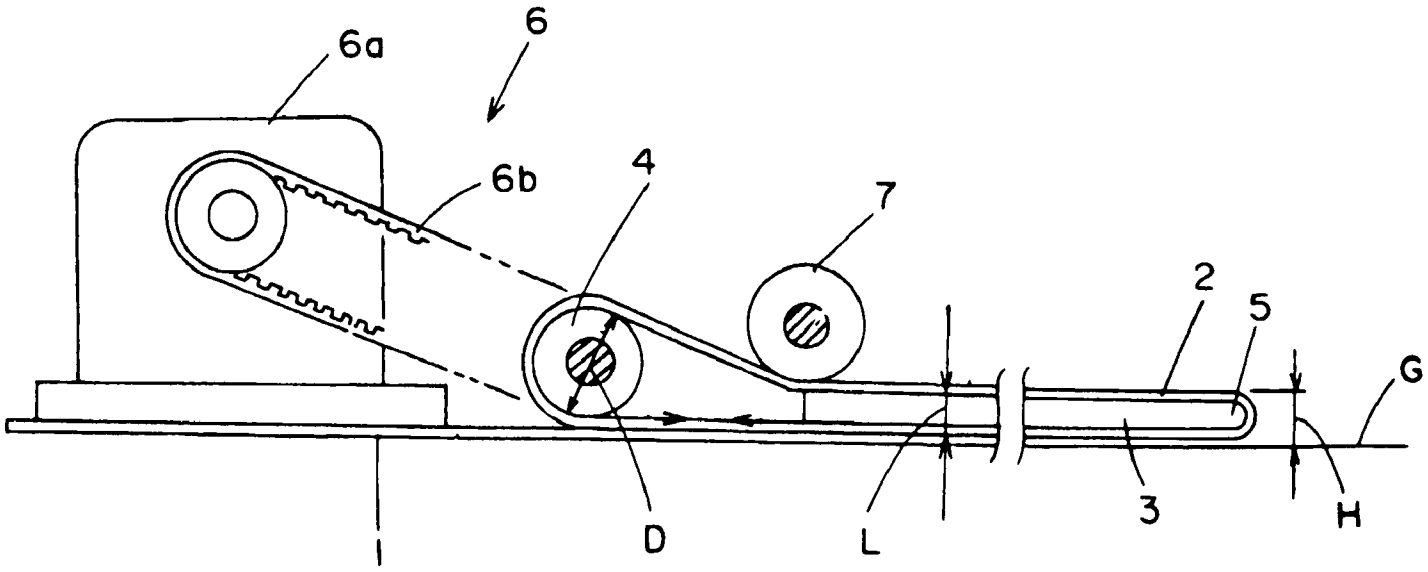
FIG. 9 is a side sectional view of a running machine according to the prior art.

FIG. 8 shows a modified embodiment of the sliding contact member 25 and the position-adjusting unit 50 of the running machine according to the invention. In this embodiment, the sliding contact member 25 is made of a separate member from the supporting plate 22. The position-adjusting unit 50 is so arranged and positioned that it can change the mounting position of the sliding contact member 25 relative to the supporting plate 22 and thus adjust the front and rear positions of the sliding contact member 25. Specifically, the position-adjusting unit 50 has such a construction that protruding member 55 and 56 are oppositely mounted to the end of the supporting plate 22 and the right and left outer sides of the sliding contact member 25, the bolt 57 is rotatably and not-movably backward and forward supported in the protruding member 55 of the supporting plate 22, a female thread 58 with which the bolt 57 is engaged is formed in the protruding member 56 of the sliding contact member 25. Accordingly, when the rotation of the bolt 57 moves backward and forward the protruding member 56 of the sliding contact member 25 via the female thread 58, the front and rear positions of the sliding contact member 25 can be set. This constitution provides the same effect as above.

Further, it is possible to mount a plurality of tension/contact rollers. Also, for the sliding contact member or the supporting plate, it is preferred to use material that reduces frictional resistance against the endless belt as much as possible. Resin, wood etc. is preferable.

According to the present running machine, even if the tension of the endless belt against the sliding contact member is reduced, since the endless belt is depressed and contacted to the rotary roller by the tension/contact roller, the slip of the endless belt out of the rotary roller is prevented and the endless belt is moved smoothly. Also, since frictional resistance of the endless belt against the sliding contact member can be reduced, durability of the endless belt can be substantially improved.

Further, since the present running machine is equipped with the tension roller which makes the distance between the upper portion and the lower portion of the endless belt smaller than the diameter of the rotary roller by depressing the upper portion toward the lower portion, the height from the ground surface to the running/walking surface of the endless belt can be lowered as much as possible without reducing the external diameter of the rotary roller and thus the running/walking part of the endless belt can be embodied as a slim type. Accordingly, when the runner/walker gets on the endless belt from the other bent part of the endless belt, he or she can easily get on and off the endless belt. Furthermore, when the runner/walker falls down from the other bent part during running/walking, shock can be relieved and safety can be improved due to the low height.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A running machine comprising, a bedplate having side frames mounted at an interval and being contacted to a ground surface;

an endless belt mounted between the side frames of the bedplate, bent down at its ends and provided with an upper portion externally positioned and having an outer surface as a running/walking surface on which a runner/walker runs or walks and a lower portion internally positioned;

a supporting plate bridged between the side frames of the bedplate, inserted between the upper portion and the lower portion of the endless belt and coming into a sliding-contact with the upper portion of the endless belt for supporting the same:

a rotary roller provided in an inner portion of one bent part of the endless belt for circulatingly moving the endless belt;

a sliding contact member mounted in an inner portion of the other bent part of the endless belt and guiding the sliding-contact movement of the endless belt;

a driving unit for rotating and driving the rotary roller; and a tension roller for depressing the upper portion of the endless belt toward the lower portion, thereby making a distance between the upper portion and the lower portion smaller than a diameter of the rotary roller; and a tension/contact roller adapted to depress and contact the endless belt to the rotary roller.

2. The running machine according to claim 1, wherein the tension/contact roller constitutes the tension roller.

3. The running machine according to claim 1 or 2, further comprising a tension/contact force-regulating unit for regulating tension contact force of the tension/contact roller.

4. The running machine according to claim 3, further comprising a position-adjusting unit for adjusting front and rear positions of the sliding contact member.

5. The running machine according to claim 4, wherein the sliding contact member constitutes an end of the supporting plate, and the position-adjusting unit is structured such that it can change a mounting position of the supporting plate relative to the bedplate, thereby adjusting front and rear positions of the sliding contact member.

6. The running machine according to claim 4, wherein the sliding contact member is mounted to an end of the supporting plate and made of a member different from the supporting plate, and the position-adjusting unit is structured such that it can change a mounting position of the sliding contact member relative to the supporting plate, thereby adjusting front and rear positions of the sliding contact member.

7. The running machine according to claim 5, wherein the sliding contact member is formed to protrude from a general plane of the supporting plate.

8. The running machine according to claim 7, wherein the height from a ground surface to the running/walking surface of the endless belt is 40 mm or less.

9. The running machine according to claim 6, wherein the sliding contact member is formed to protrude from a general plane of the supporting plate.

10. The running machine according to claim 9, wherein the height from a ground surface to the running/walking surface of the endless belt is 40 mm or less.

* * * * *